US005782046A

United States Patent [19]

Karlsson

[11] Patent Number: 5,782,046

[45] Date of Patent: Jul. 21, 1998

[54] ISOLATED LOG ELEMENT

[76] Inventor: Hans Karlsson, Sörvägen 540, S-940 92 Lillpite, Sweden

[21] Appl. No.: 737,128

[22] PCT Filed: May 4, 1995

[86] PCT No.: PCT/SE95/00488

§ 371 Date: Feb. 18, 1997

§ 102(e) Date: Feb. 18, 1997

[87] PCT Pub. No.: WO95/30807

PCT Pub. Date: Nov. 16, 1995

[30] Foreign Application Priority Data

May 6, 1994 [SE] Sweden ..... 9401585

[51] Int. Cl.[6] ..... E04C 3/12

[52] U.S. Cl. ..... 52/233; 52/309.11; 52/730.7

[58] Field of Search ..... 52/730.7, 731.3, 52/732.2, 233, DIG. 8; 446/106

[56] References Cited

U.S. PATENT DOCUMENTS

| | | | |
|---|---|---|---|
| Re. 35,327 | 9/1996 | Sing | 52/309.11 X |
| 1,758,046 | 5/1930 | Ilson | 52/233 |
| 3,969,859 | 7/1976 | Hisey | 52/233 X |
| 5,207,046 | 5/1993 | Vekkeli | 52/731.3 X |
| 5,253,458 | 10/1993 | Christian | 52/233 |

FOREIGN PATENT DOCUMENTS

| | | | |
|---|---|---|---|
| 262567 | 6/1968 | Austria | 52/233 |
| 1439058 | 4/1966 | France | 52/233 |
| 2802275 | 7/1978 | Germany | 52/233 |
| 33743 | 1/1922 | Norway | 52/233 |
| WO 91/08359 | 6/1991 | WIPO | 52/233 |

*Primary Examiner*—Wynn E. Wood
*Assistant Examiner*—Laura A. Callo
*Attorney, Agent, or Firm*—John Lezdey

[57] ABSTRACT

The present invention relates to a wooden log element which is intended to be stacked with similar log elements to form a wall structure while using a corner jointing technique. The log element includes surface parts having inwardly facing surfaces which are provided with grooves that extend in the longitudinal direction of the log element. It further includes spacers which function to hold the surface parts in a supported mutually spaced relationship. An empty space between the surface parts is filled with a thermal insulating material which when cured will fix the outer parts and the spacers in position. The log element has the form of a natural log in which the outer parts disposed on each side of the thermal insulating material have an arcuate cross-sectional shape and are formed by a plurality of mutually joined panel elements with the spacers disposed therebetween in a mutually spaced relationship along the full length of the log element and essentially enclosed by the thermally insulating material. For the purpose of shape-locking the outer parts together in all directions, the spacers have a square frame construction in which mutually intersecting outer end parts project out from the corners of the frame construction and are fixed together at the corners. The end-portions of the outer end parts are received in the grooves that extend longitudinally in the inwardly facing surfaces of the outer log parts.

11 Claims, 2 Drawing Sheets

ISOLATED LOG ELEMENT

BACKGROUND OF THE INVENTION

1. Field of the Invention

The present invention relates to log elements which can be stacked upon one another to form a wall structure and more particularly, to form a wooden log cabin.

2. Description of the Prior Art

Log cabins are generally constructed from solid logs which are provided with corner jointing recesses at both ends thereof, wherein the logs are placed one on top of the other and tier-jointed at the corners of respective cabin walls. Cabins that are built of logs that are "dovetailed" at the corners of the cabin walls have an attractive, rugged appearance and consequently many people wish to use this construction technique when building weekend cottages and like occasional dwellings. However, the overall coefficient of heat transfer of walls that are comprised of "dovetailed" natural timber is much too high to afford adequate insulation. The thermal insulation of corner-jointed log structures is a serious problem, particularly when the builder desires inner wall surfaces that have the appearance of old-fashioned timber walls with the logs clearly visible from inside the building, for the sake of appearance.

In order to improve the insulating properties of the log elements while retaining their mechanical strength, bearing capacity and torsional resistance, the Swedish Patent Specifications 440 250 and 457 456 propose the use of log elements having wooden outer parts whose inwardly facing surfaces are provided with grooves which extend in the longitudinal direction of the log element. These outer parts are held spaced from one another with the aid of spacers and the empty space between these outer parts are filled with a heat-insulating material, preferably polyurethane, which when cured fixes the outer parts and the spacers in position. The outer parts of these known log elements are exclusively load-absorbing or, in coaction with the spacers, only partially load-absorbing, to this end have a rectangular cross-sectional shape formed by a single panel element or a number of mutually joined panel elements.

One problem with these known insulated log elements is that a wall constructed therefrom will dry-out and contract in time, therewith lowering the height of the wall. In the case of a wall of circa 2 meters in height, the extent of this contraction may be as high as 5 cm. These dimensional changes, which continue for from one to two years, occur transversely to the fibre direction, which means that the wood loss in the vertical direction of the outer parts of each of the aforesaid known log panels will result in a large loss for the wall as a whole when taken together. Consequently, it is necessary for a wall constructed from these log elements to be given enough time to settle before any internal decoration work can be commenced, resulting in long construction times and higher costs.

It has been found in practice that the shape or form of these log elements never ceases to change completely, due to the fact that they are subjected constantly to changes in atmospheric humidity. Because the air present in the house is warm and dry during those periods of the year when the relative humidity of the outside air is at its highest causes the wood to dry in different directions from the outside and the inside of the log walls. This results in very high stresses and therewith in pronoun changes in shape or form of the log elements. Consequently, wall panels or like furnishings fitted on the inner surface of the log walls will tend to bend or crack.

Accordingly, one object of the invention is to provide a log element which will exhibit minimum contraction in a vertical direction in comparison with hitherto known insulated log elements, and which has the shape of a naturally round log and whose outer parts are shape-locked in all directions with the aid of spacers in a manner to eliminate the danger of the log element changing in shape.

A further object of the invention is to enable surface wood or bark to be used in the construction of the inventive log element. By surface wood is meant the outermost pieces sawn from a log and having so much wane that it is considered uneconomical to process these pieces for use in wooden structures for instance and which are therefore normally chipped.

SUMMARY OF THE INVENTION

These objects cannot be achieved with hitherto known log elements. The objects are achieved, however, with the inventive log element having the characteristic features of a plurality of log elements which can be stacked upon each other to form a wall structure. Each log element has a cavity. Each log element includes arcuate cross-sectional shaped surface parts which are formed from a plurality of mutually joined panel elements. The surface parts include inwardly and outwardly facing surface. The inwardly facing surface has a groove extending in a longitudinal direction of the log element. Spacers are positioned in a mutually spaced relationship inside of the cavity of the log element. A thermal insulating material is positioned inside of the cavity of the log element and hold the surface parts and the spacers in a fixed position. Each spacer is square shaped and include mutually intersecting outer end parts which are fixed at and projecting outwards from corners of the square shaped spacers. The outer end parts are received in the grooves.

The invention will now be described in more detail with reference to a non-limiting exemplifying embodiment thereof illustrated in the accompanying drawings.

DESCRIPTION OF THE PREFERRED EMBODIMENTS

Figure 1:
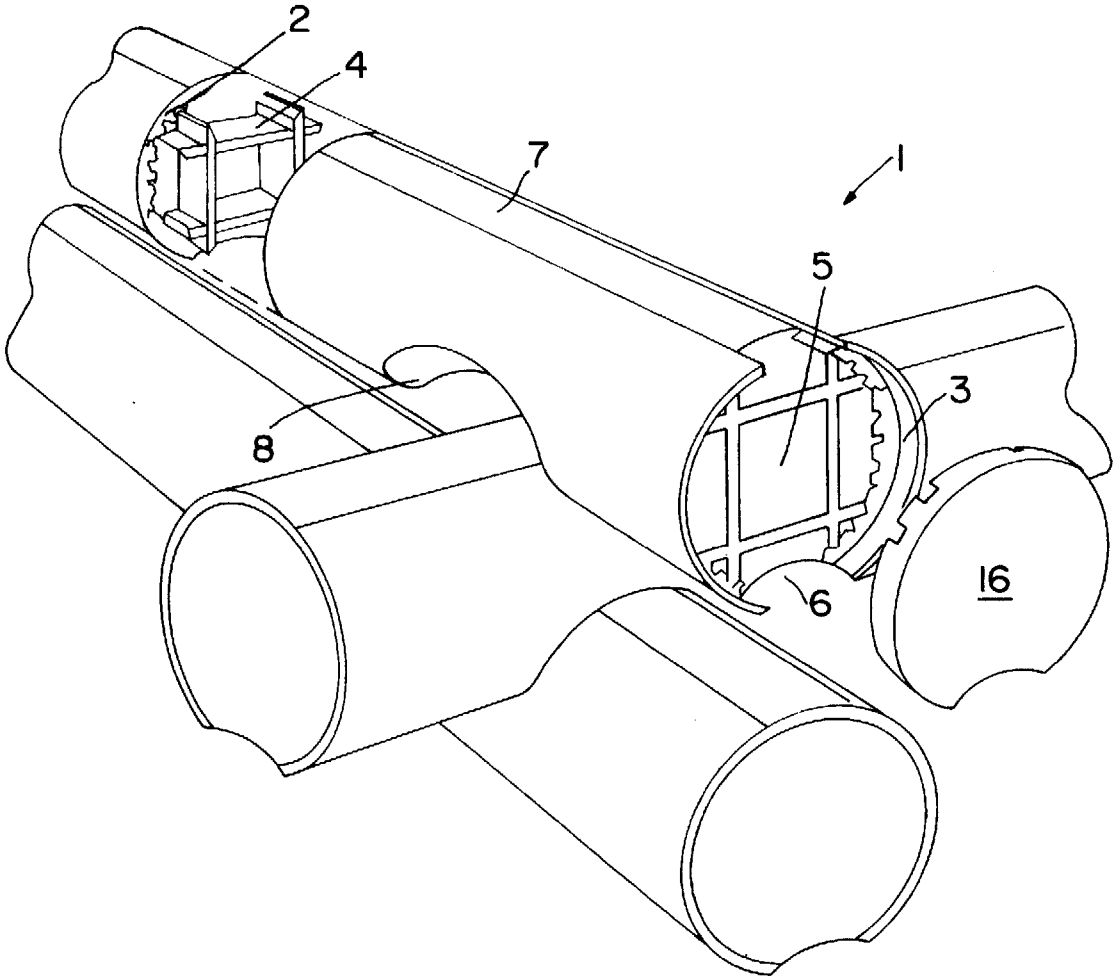
FIG. 1 is a perspective view of mutually joined inventive log elements, of which the top log element is shown partially in section, with one end-piece of the log element being shown separated from the remainder of the log.

The log element 1 shown in FIG. 1 has an outer layer in the form of a plurality of surface panels produced from panel elements 2 and planed to a particular shape which enables the elements to be joined, e.g., glued, to surface parts 3 which, in section, have the form of arcuate parts of a hollow cylindrical log. In order to make the log element 1 self-supporting, spacers 4 are disposed in suitable mutually spaced relationship inside the log element, along the full length thereof. These spacers 4 are intended to take-up forces and to stabilize and shape-lock the outer parts 3 formed by the panel elements 2. In order to enable the log elements to be stacked one on the other while obtaining an essentially continuous insulating layer throughout the entire stack, insulating material 5 extends through the entire log, i.e. from the upper side to the lower side of the log and along the full length of the log. In this regard, the underside of the log includes a longitudinally extending recess 6, while the upper side of the log has a shape which is complementary to the shape of the recess 6.

The inventive log elements 1 can be joined together with the aid of a known corner locking technique and by optionally bracing stacked log elements with the aid of tension rods extending through a constructed wall. For instance, to enable the log elements 1 to be joined together, each log may be provided with a necked part in the vicinity of each end thereof or at locations at which logs are to be joined to the logs of an intersecting wall structure, i.e. may be provided with opposing recesses on each side of the log. Alternatively, the upper log element of the meeting wall structure nay be provided with a recess 8 which has a depth corresponding to half the thickness of said log element, or to the radius of a round log element, and which corresponds in shape to the shape of the upper surface of an underlying log element, as shown in FIG. 1. This enables an upper log element to be fitted readily to a lower log element, as indicated in FIG. 1. Irrespective of the corner jointing technique used, however, the insulated layer 5 will always extend to the upper and the lower side of each recess, therewith fully insulating the walls in the absence of cold bridges at the corners of the structure, while the insulating material functions to provide a completely sealed corner joint when the log elements are joined together in the manner shown in FIG. 1.

Figure 2:
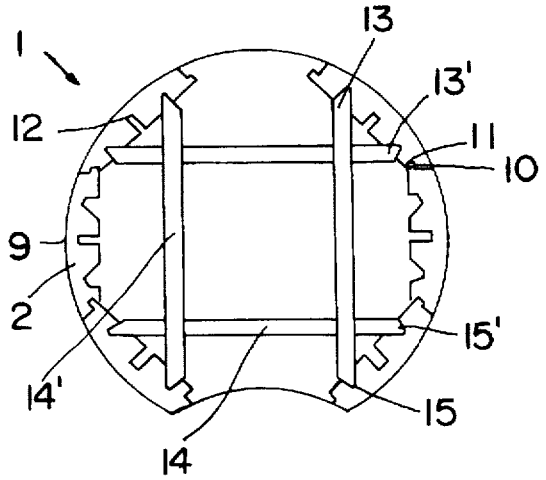
FIG. 2 is a cross-sectional view of one end-part of the inventive log element.

FIG. 2 is a cross-sectional view of a first embodiment of the inventive log element 1, wherein each panel element 2 in the log element 1 has an outwardly facing, visible outer surface 9 and an inwardly facing surface provided with longitudinally extending grooves, said panel element 2 being curved appropriately to obtain a round log element. In order to enable the panel elements 2 to be fitted together to form parts of a round log and therewith ensure that the panel elements will be connected stably with one another, one longitudinal edge of the panel elements 2 is provided with a longitudinally extending tongue 10, whereas the other longitudinally extending edge or said panel elements is provided with a corresponding longitudinally extending groove 11. The tongue 10 of respective panel elements is intended to be brought into engagement with a corresponding groove 11 on one side of an adjacent panel element 2, whereas the groove extending along the other side of the panel element is intended to receive the tongue of an adjacent panel element. In addition to the stabilizing effect thus obtained, the tongue-and-groove arrangement is also intended to prevent the ingress of water. The inwardly facing surface of the centre part of each panel element 2 is also provided with a longitudinally extending slot 12 which functions to prevent twisting of the panel elements 2 prior to assembly.

When machining the panel elements 2, the outwardly visible surfaces of the panel elements are given year rings which follow the curvature of the log in a natural way, such that when assembled a finished log element will have the appearance of a log taken from a tree trunk. The outer parts 3 formed by the panel elements 2 are held spaced apart, braced and kept together by means of spacers 4. These spacers each have the form of a square frame structure having vertical and horizontal mutually intersecting frame parts, which are fixed together and have outwardly projecting end portions 13, 13'. In one practical embodiment of the invention, each of the spacers includes at least four wooden spacer members 14, 14' arranged in a square frame construction 14. The spacer members extend vertically and horizontally so as to intersect one another and are appropriately joined together and have outer ends 13, 13' which project out from their points of intersection at right angles to one another.

The outwardly projecting end portions 13, 13' of the square spacers 4 are received in longitudinally extending grooves or slots 15, 15' provided in the inwardly facing surfaces of respective panel elements 2. As will be seen from FIG. 2, when the outer parts formed by the panel elements are assembled, the outer parts will be held together by virtue of the projecting outer ends 13, 13' of the spacers being received in the grooves or slots 15, 15', said outer ends being glued in said slots, for instance. This arrangement ensures that the outer parts 3 of the finished log element 1 will be shape-bound to one another in all directions in a manner which will prevent the outer parts from being separated from one another, e.g. from being pulled apart. In order to take-up the forces and loads to which the log element is subjected, at least two of the wooden spacer members 14 will preferably extend generally vertically and at least two of said spacer members 14' will extend generally horizontally.

So that the load-bearing capacity of the inventive log elements 1 can be utilized to the best effect, it is important that the spacers 4 of each log element are disposed essentially in the same vertical plane when the log elements 1 are stacked one upon the other. When a load is applied to the upper edge of a wall constructed from the inventive log elements 1 with the spacers so arranged, the force exerted by an applied load will be transmitted through the spacers structure down to the underlying surface on which the wall rests. The number of spacers 4 used, their dimensions and positioning are determined primarily by the desired strength of the structure built with log elements 1, although the number of spaces 4 used will be as small as possible, since they form cold bridges.

One important feature of the present invention is that the force-absorbing and load-transmitting spacers 4 are enclosed essentially in the insulating polyurethane foam 5. This is of particular importance in the aforesaid practical embodiment of the invention in which the spacers 4 are constructed from four wooden spacer members 14, 14' disposed in the form of a square frame structure which be kept from contact with the ambient atmosphere, in order to avoid shrinkage. It is also important that the fibres of the wooden spacer members 14, 14' are orientated in the longitudinal direction of the spacer members, so as to further reduce the risk of shrinkage or contraction. As a result of this enclosure of the load-transferring spacer members 4, shrinkage of the log element 1 in its cross-direction will be extremely small or practically non-existent.

Before describing the manufacture of the inventive log element, it should be mentioned that a suitable adhesive is applied to all jointing locations prior to the log elements being fitted together, although this will be obvious to one skilled in this art.

The inventive log element 1 is manufactured in the following way. Two panel elements 2 are joined together through the medium of their respective groves 11 and tongues 10 on each side of the bottom half of an internally round mould which can be divided at a location corresponding to half the height of the mould, the dimensions of which correspond to the dimensions of the finished lag element 1. The panel elements 2 are fixed in position in suitable space relationship with the aid of the spacers 4, the spacing of the spacers being dependent on the desired mechanical strength of the log element. The thus formed unit is then lifted from the mould wherein the still only partially formed outer parts of the unit will fall slightly outwards from the upper part of the mould half, wherein each outer part can now be completed by joining each of the two remaining panel elements 2 to respective partially form outer parts 3, through the medium of their grooves 11 and tongues 10.

It will be understood in this regard that the "impossible" form-bound locking of the panel elements in all directions resulting from the mutual coaction of the spacers 4 and the outer parts 3 enables the outer parts to be formed by a plurality of mutually joinable panel elements 2 whose tongues 10 and grooves 11 engage in one another while permitting limited but still sufficient movement to enable the log elements 1 to be fitted together.

After having closed the mould, by placing the upper mould half on top of the lower mould half and sealing the ends of the mould, the mould is filled with a curable foam 5, e.g. polyurethane foam, which fills the mould cavity and binds the log element cones together. When the foam has set or hardened, the formed log element is removed from the mould. The underside 6 of the log element 1 is then recessed to provide a log element of circle-segmental cross-section and the upper side 7 of the log is given a shape which is complementary to the underside of the log, as shown in FIG. 1, so that the upper side of the log element be received in the recessed bottom side of an overlying log element when assembling the wall.

As will be seen from FIG. 1, the ends of respective logs are out-out and fitted with end-pieces 16. These end-pieces are comprised of solid end covers that have been cut from natural timber logs and turned on a lathe to fit into the cavity milled in the end of the log element 1. The end-pieces 16 form end plugs which ensure that the insulating material 5 will be fully enclosed in the respective log elements 1 of a wall structure. The end-plugs 16 extend into respective ends of a log element 1 and are glued and pinned thereto. The end-plugs 16 are provided with grooves to prevent shear tendencies.

Although not shown, an elastic sealing device, e.g. a rubber strip, can be placed between the log elements 1 so as to obtain a watertight connection. Alternatively, the upper panel element of the panel elements 2 that lie adjacent a region between two contiguous log elements 1 may be provided with a longitudinally extending water-conducting groove.

Figure 3:
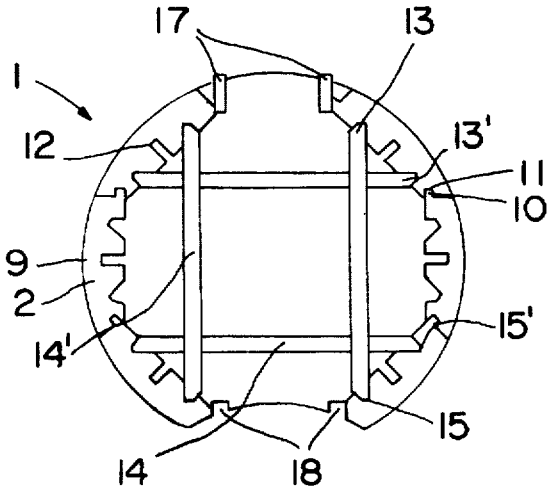
FIG. 3 is a cross-sectional view of one end-part of an alternative embodiment of an inventive log element.

FIG. 3 is a cross-sectional view of a further embodiment of an inventive log element 1, in which in addition to the recess 6 provided on the underside of the log and the complementary shaped upper side 7 of said log, the upper side of the log is provided with a continuous, longitudinally extending guide strip 17 while the underside of the log is provided with a corresponding longitudinally extending slot 18 at each edge part of the recess 6. This ensures that the log elements will be fixed in position when placed one on top of the other to form a wall section.

It is conceivable within the scope of the present invention to give the stock element 1 a different cross-sectional shape to that shown in the illustrative embodiment, and to produce the log element from a different material. The recesses provided in the log elements 1 for the purpose of jointing the same in a wall structure may, of course, be given a shape different to that illustrated. It is also possible to produce the log elements 1 without insulation and to apply a continuous insulating layer to a wall structure built from the log elements 1. It will also be understood that the aforedescribed spacer 4 may be made of an appropriate material other than wood, for instance a suitable plastic material, aluminium or like material, and also that the panel elements may be disposed adjacent one another in a manner which will impart the form of a continuous circle to the log element when seen in cross-section.

What is claimed is:

1. Wooden log elements (1) adapted to be stacked one upon another to form a wall structure, each of the log elements including surface parts (3) having inwardly facing surfaces which are provided with grooves (12, 15, 15') that extend in a longitudinal direction of the log element (1), and further including spacers (4) which hold the surface parts (3) in supported mutually spaced relationship, wherein a space is formed between the surface parts and is filled with a thermally insulating material (5) which fixes the surface parts (3) and the spacers (4) in position, further characterized in that the log element (1) has the form of a natural log wherein the surface parts (3) are disposed on sides of the thermally insulating material (5) and have an arcuate cross-sectional shape and are formed by a plurality of mutually joined panel elements (2) with the spacers (4) disposed therebetween in mutually spaced relationship along the full length of the log element (1) and substantially enclosed by the thermally insulating material (5), wherein for the purpose of shape-locking the surface parts (3) together in all directions, the spacers (4) comprise a square frame construction having corners and having mutually intersecting outer end parts (13,13') projecting out from the corners, wherein the outer end parts are fixed together at said corners and have ends which are received in the grooves (15,15') that extend longitudinally in the inwardly facing surfaces of the surface parts (3).

2. A plurality of log elements which are adapted to be stacked upon each other to form a wall structure; each log element having a cavity and comprising: arcuate cross-sectional shaped surface parts formed from a plurality of mutually joined panel elements; said surface parts including inwardly and outwardly facing surfaces; said inwardly facing surface having a groove extending in a longitudinal direction of said log element; spacers positioned in a mutually spaced relationship inside of said cavity of said log element for holding said surface parts; a thermal insulating material positioned inside of said cavity of said element for holding said surface parts and said spacers in a fixed position; and each spacer being square shaped and including mutually intersecting outer end parts fixed at and projecting outwards from corners of said square shaped spacers; wherein said outer end parts are received in said grooves.

3. The log element according to claim 2, said log element comprising a wooden material and being in a form of a natural log.

4. The log element according to claim 2, wherein said thermal insulating material comprises polyurethane.

5. The log element according to claim 2, wherein each spacer comprises at least four spacer members having mutually connected outer ends.

6. The log element according to claim 5, wherein said spacer members comprise a wooden material.

7. The log element according to claim 5, wherein two of said spacer members extend substantially in a vertical direction and two other of said spacer members extend substantially in a horizontal direction.

8. The log element according to claim 2, wherein said thermal insulating material fills substantially all of said cavity of said log element; and wherein said log element includes an upper side and a lower side; said lower side of said log element having a recess and said upper side of said log element having a complementary shape for fitting inside of said recess of said lower side.

9. The log element according to claim 2, wherein said spacers are substantially enclosed by said insulating material.

10. The log element according to claim 2, wherein said spacers are separated by a distance commensurate to a preselected strength requirement of said log element.

11. The log element according to claim 2, wherein each panel element comprises: a curved, outer visible surface; a first longitudinally extending edge having a continuous tongue; and a second longitudinally extending edge having a complementary continuous groove.

* * * * *